US006860556B2

(12) United States Patent
Barile, Sr. et al.

(10) Patent No.: US 6,860,556 B2
(45) Date of Patent: Mar. 1, 2005

(54) CHAIR FRAME FOR A STACKABLE CHAIR

(75) Inventors: Peter Barile, Sr., Morristown, TN (US); Peter W. Barile, Jr., Morristown, TN (US)

(73) Assignee: Daniel Paul Chairs, LLC, Morristown, TN (US)

( * ) Notice: Subject to any disclaimer, the term of this patent is extended or adjusted under 35 U.S.C. 154(b) by 0 days.

(21) Appl. No.: 10/425,297

(22) Filed: Apr. 29, 2003

(65) Prior Publication Data

US 2004/0217635 A1 Nov. 4, 2004

(51) Int. Cl.[7] ..... A47C 3/04
(52) U.S. Cl. ..... 297/239; 297/448.1
(58) Field of Search ..... 297/239, 448.1, 297/440.15, 445.1

(56) References Cited

U.S. PATENT DOCUMENTS

| | | | | | |
|---|---|---|---|---|---|
| 2,936,024 | A | * | 5/1960 | Hendrickson | 297/239 |
| 2,952,300 | A | * | 9/1960 | Cohen | 297/239 |
| 3,159,425 | A | * | 12/1964 | Engstrom | 297/248 |
| 3,203,731 | A | | 8/1965 | Krueger | |
| 3,316,016 | A | | 4/1967 | Petersen | |
| 4,057,288 | A | | 11/1977 | Schwartz et al. | |
| 5,094,507 | A | * | 3/1992 | Gibbs | 297/239 |
| 5,762,396 | A | | 6/1998 | Barile | |
| 5,863,096 | A | * | 1/1999 | Bartlmae | 297/248 |
| 6,174,029 | B1 | * | 1/2001 | Swy | 297/448.1 |
| 6,450,575 | B1 | * | 9/2002 | Liu | 297/239 |
| 2003/0047981 | A1 | * | 3/2003 | Roth | 297/445.1 |

* cited by examiner

*Primary Examiner*—Rodney B. White
(74) *Attorney, Agent, or Firm*—Pitts & Brittian, P.C.

(57) ABSTRACT

A chair frame (10) for a stackable chair. The chair frame (10) includes a seat support portion (12) for support the seat portion (18) of a chair, and includes a pair of leg assemblies (22, 24) oppositely disposed on either side of the seat support portion (12). Each leg assembly (22, 24) includes a front leg (26) and a rear leg (28), and an upper support member (30). Each upper support member (30) has an upper surface (38), at least a portion of which defines a curvilinear surface portion. Each leg assembly (22, 24) also includes a stacking bar (32) extending between the front leg (26) and the rear leg (28), the stacking bar (32) being disposed below, and being selectively space from, the upper support member (30). The stacking bar (32) of each leg assembly (22, 24) has a lower surface (36), at least a portion of which defines a curvilinear surface portion configured to closely engage at least a portion of the curvilinear surface portion of the upper surface (38) of the upper support member (30) of another chair frame (10) to facilitate the stacking of a plurality of chairs utilizing the chair frame (10).

14 Claims, 8 Drawing Sheets

CHAIR FRAME FOR A STACKABLE CHAIR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to a chair frame for stackable chairs. More specifically, the present invention is related to a chair frame for a stackable chair which incorporates stacking bars which facilitate the stable stacking of chairs utilizing the frame such that the chairs can be safely stored.

2. Description of the Related Art

Chairs which can be stacked upon one another to facilitate their storage are known in the art. For example, such chairs are disclosed in U.S. Pat. No. 3,316,016. Typically, however, when chairs such as those disclosed in U.S. Pat. No. 3,316,016 are stacked the lower surface of the seat bottom of one chair is supported on the seat cushion of the chair below it. Whereas seat cushions generally will serve to support chairs stacked thereon, the flexibility of the cushion can undermine the stability of the resulting stack of chairs such that relatively few chairs can be safely stacked. Further, the leg members of most stackable chairs are secured to the lower surface of the seat portion, and the lower surface of such chairs can define other irregular surfaces. As a result, it is common for impressions of the legs and/or other irregular features of the lower surface of the seat bottoms to remain in the cushions of the chairs when they are unstacked. These impressions are aesthetically undesirable, and over time damage can result, requiring the replacement of the cushion or replacement of the chair.

In order to avoid damage to the seat cushions one prior art design which is disclosed in U.S. Pat. No. 3,203,731 utilizes a folding back portion which is pivoted down to cover the seat cushion, such that the chair stacked above rests on the rear surface of the back portion of the chair below. Whereas this design avoids the problem of an irregular surface of the upper chair resting upon the seat cushion of the chair below, undesirable pressure is still exerted on the seat cushion, and the folding back portion of the chair makes the chair expensive and complicated to manufacture.

Other prior art designs have attempted avoid damage to the seat cushion by providing stacking bars or supports which extend between the front and back legs of the chair. The stacking bars provide a support which engages the frame of the chair below and supports the upper chair on the frame of the lower chair such that the lower surface of the upper chair is spaced from the upper surface of the seat cushion of the chair below. For example, such designs are disclosed in U.S. Pat. Nos. 4,057,288, 5,762,396, and 6,174,029. The use of stacking bars does serve to avoid damage to the seat cushions of the chairs when they are stacked. However, prior art stacking bars are typically straight chair frame portions which rest upon straight frame portions which boarder the seat cushion of the chair below. Unless the frame of the chair above tightly interlocks with the frame of the chair below, the stacking bars may engage the frame portions of the chair below at various locations alone the length of the frame portions of the chair below, or the stacking bars may slide with respect to the frame portions on which they rest. This can cause a stack of chairs to become unstable, thereby limiting the number of chairs that can safely be stacked. For example, depending upon the configuration of the particular chairs being stacked, positioning the stacking bars too far to the rear on the frame portions of the chair below may cause too much of the weight of the stacked chairs to be shifted to the rear, causing the stack of chairs to fall. Of course, if the legs of the upper chair engage the legs of the chair below this front to rear sliding of the stacking bars with respect to the frame portion of the chair below can be avoided. However, configuring the chair frames such that they closely interlock can make stacking and unstacking the chairs difficult, and engagement of the upper chair frame with the chair frame of the chair below can cause damage to both chairs.

BRIEF SUMMARY OF THE INVENTION

The present invention provides a chair frame for a stackable chair. The chair frame comprises a seat support portion for support a chair seat, and a pair of leg assemblies oppositely disposed on either side of the seat support portion. Each leg assembly includes a front leg and a rear leg, and an upper support member. Each upper support member has an upper surface, at least a portion of which defines a curvilinear surface portion. In the preferred illustrated embodiments of the invention this curvilinear surface portion defines either a convex configuration, or a truncated convex configuration. Each leg assembly also includes a stacking bar extending between the front leg and the rear leg, the stacking bar being disposed below, and being selectively space from the upper support member. The stacking bar of each leg assembly has a lower surface, at least a portion of which defines a curvilinear surface portion configured to closely engage at least a portion of the curvilinear surface portion of the upper surface of the upper support member of another chair frame of the present invention to facilitate the stacking of the chair frame on such other chair frame. In the preferred illustrated embodiments of the invention this curvilinear surface portion of each stacking bar defines either a concave configuration, or a truncated concave configuration. As will be discussed in detail below, the close engagement of the curvilinear surface portions of the upper support members of the chair frame with the curvilinear surface portions of the stacking bars of another chair frame stacked above facilitates the stable stacking of a plurality of chairs utilizing the chair frames of the present invention.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
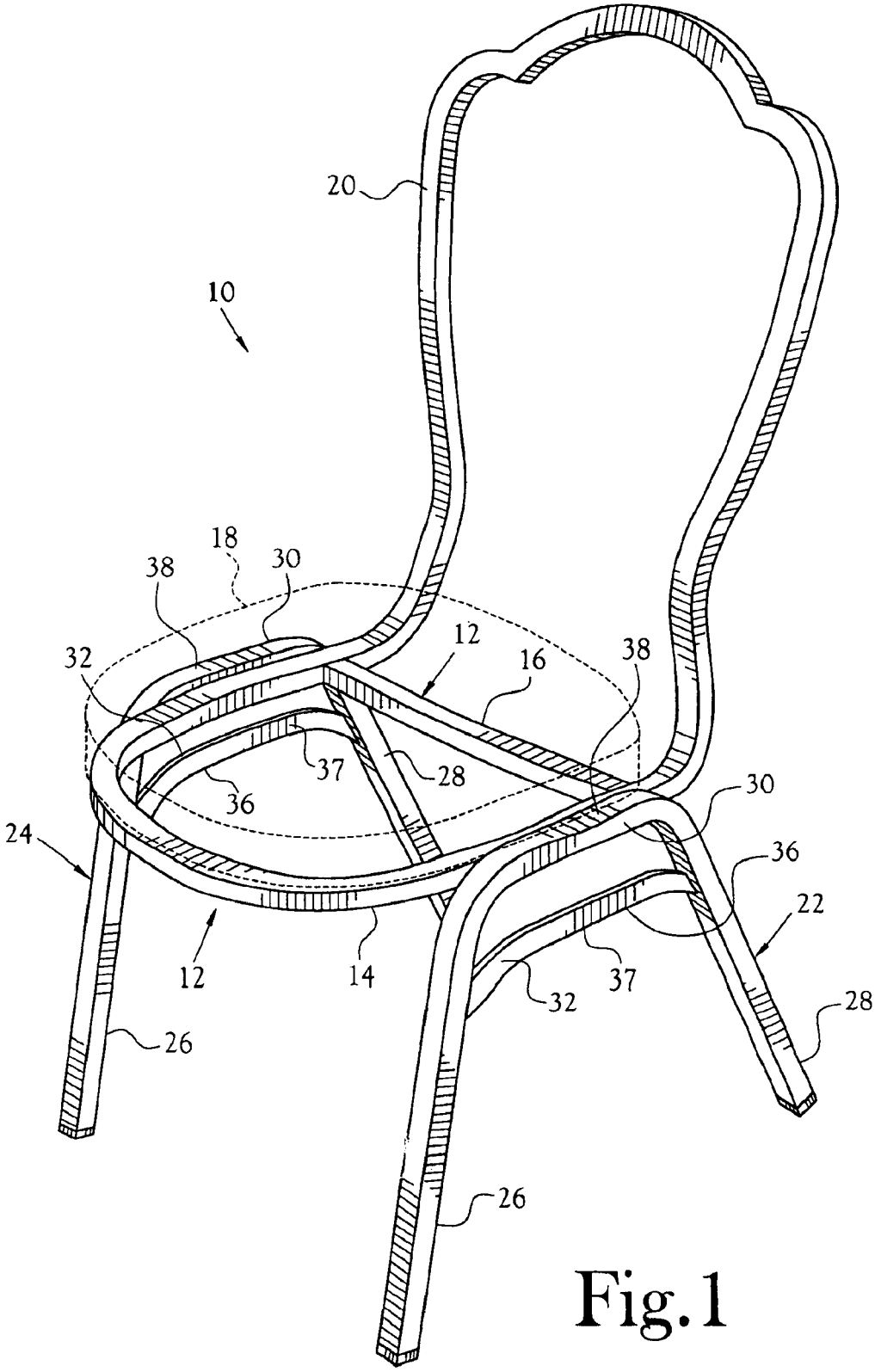
FIG. 1 is a perspective view of a chair frame for a stackable chair of the present invention.
Figure 2:
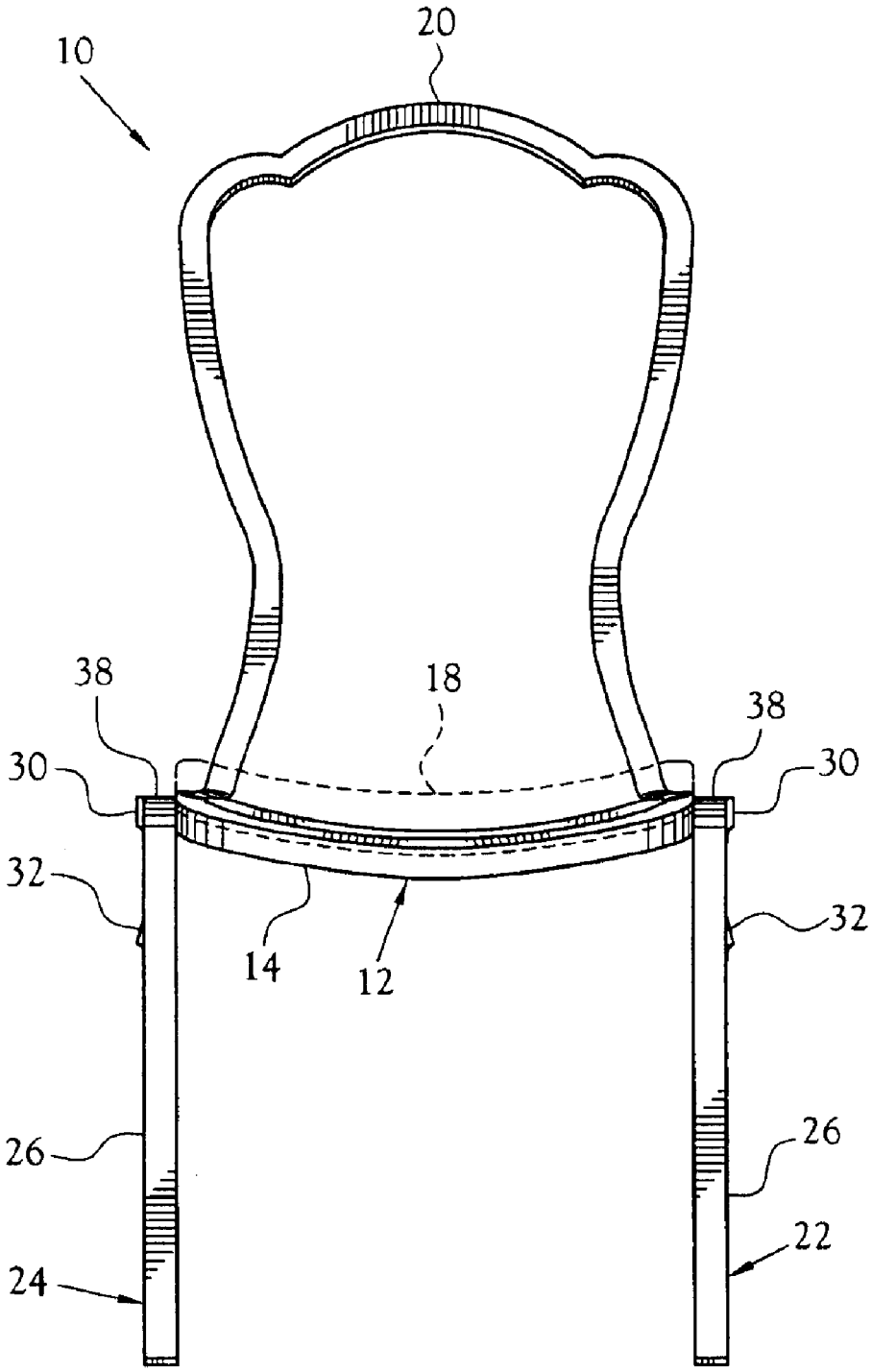
FIG. 2 is a front elevation view of a chair frame for a stackable chair of the present invention of the present invention.
Figure 3:
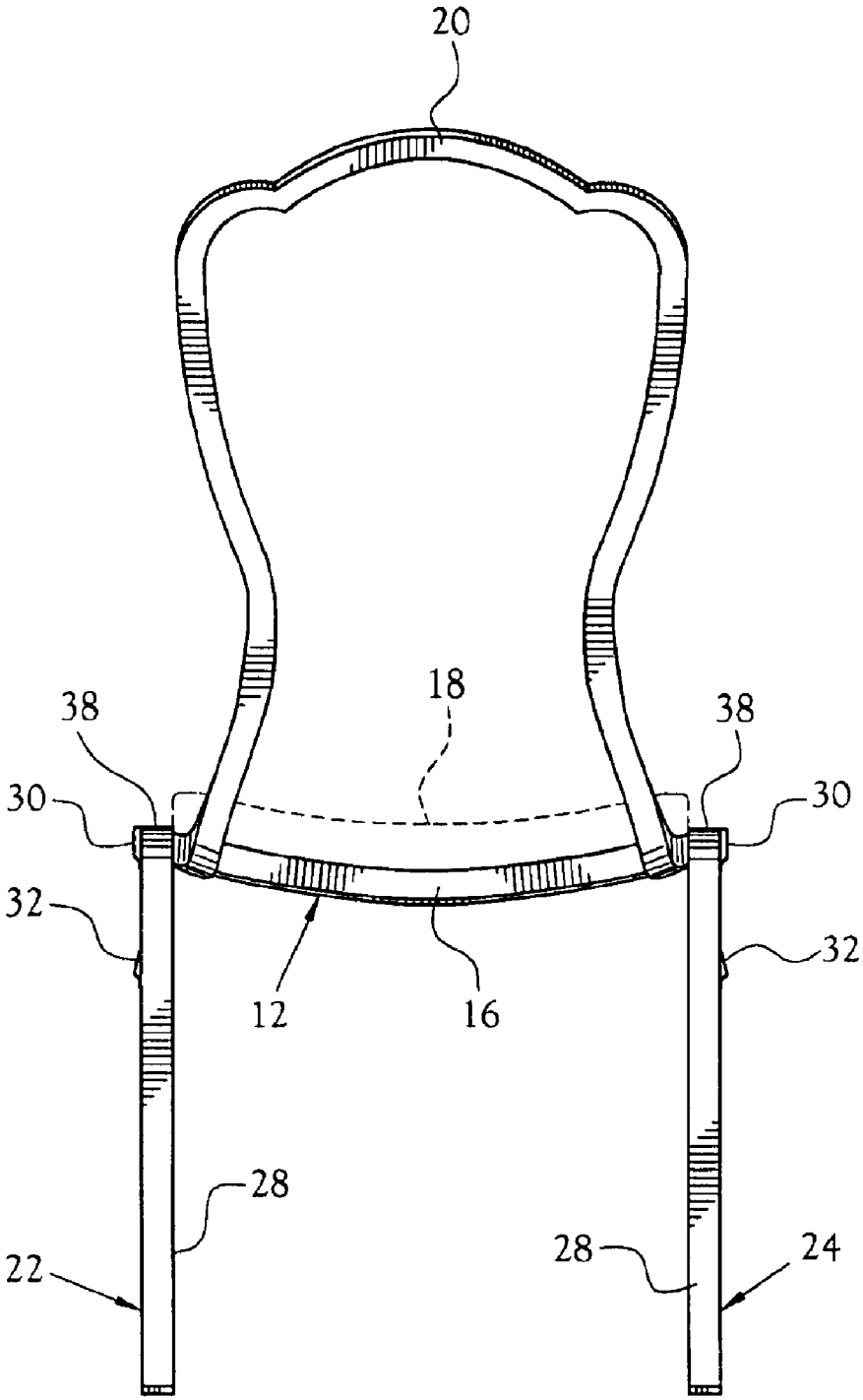
FIG. 3 is a rear elevation view of a chair frame for a stackable chair of the present invention.
Figure 4:
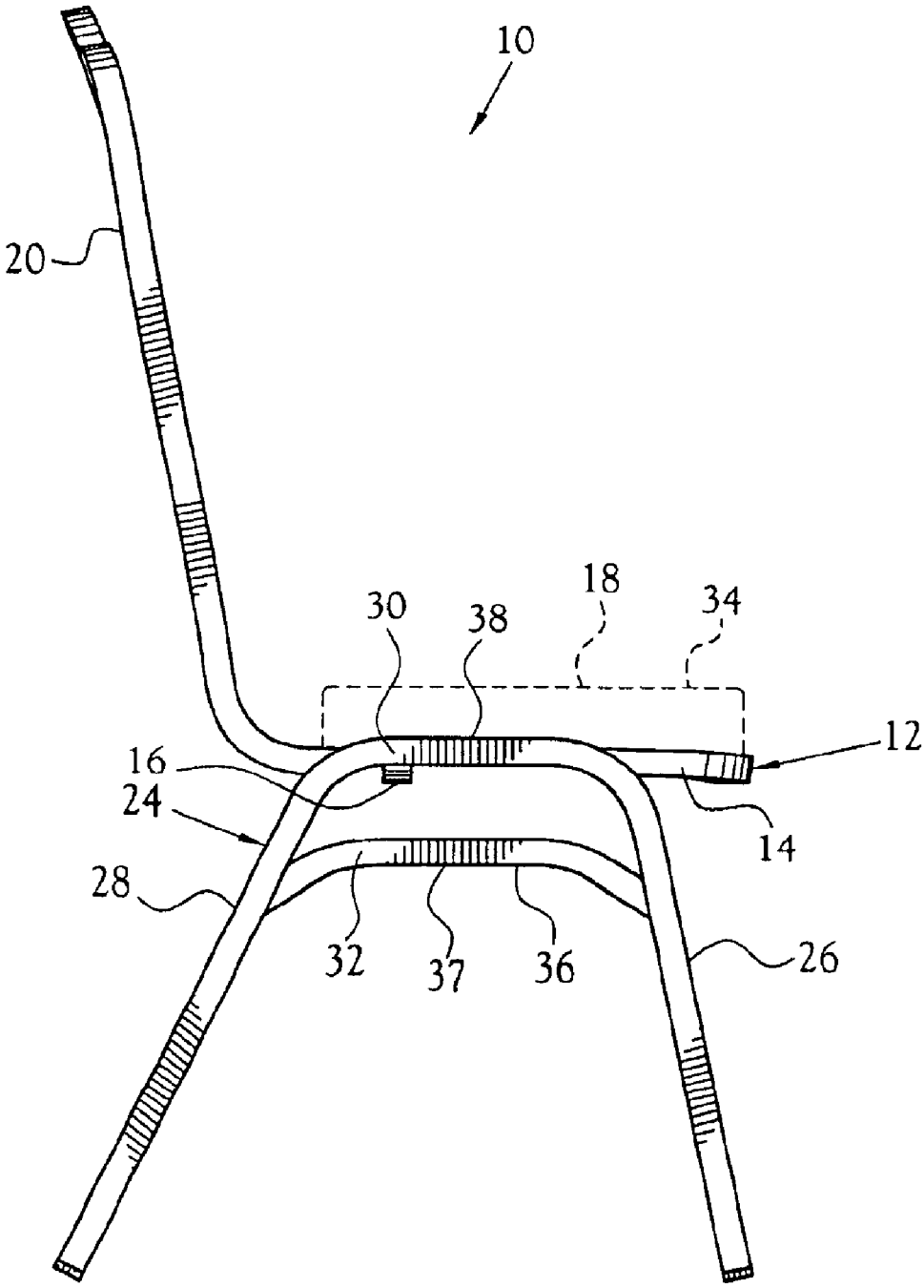
FIG. 4 is a side elevation view of a chair frame for a stackable chair of the present invention.
Figure 5:
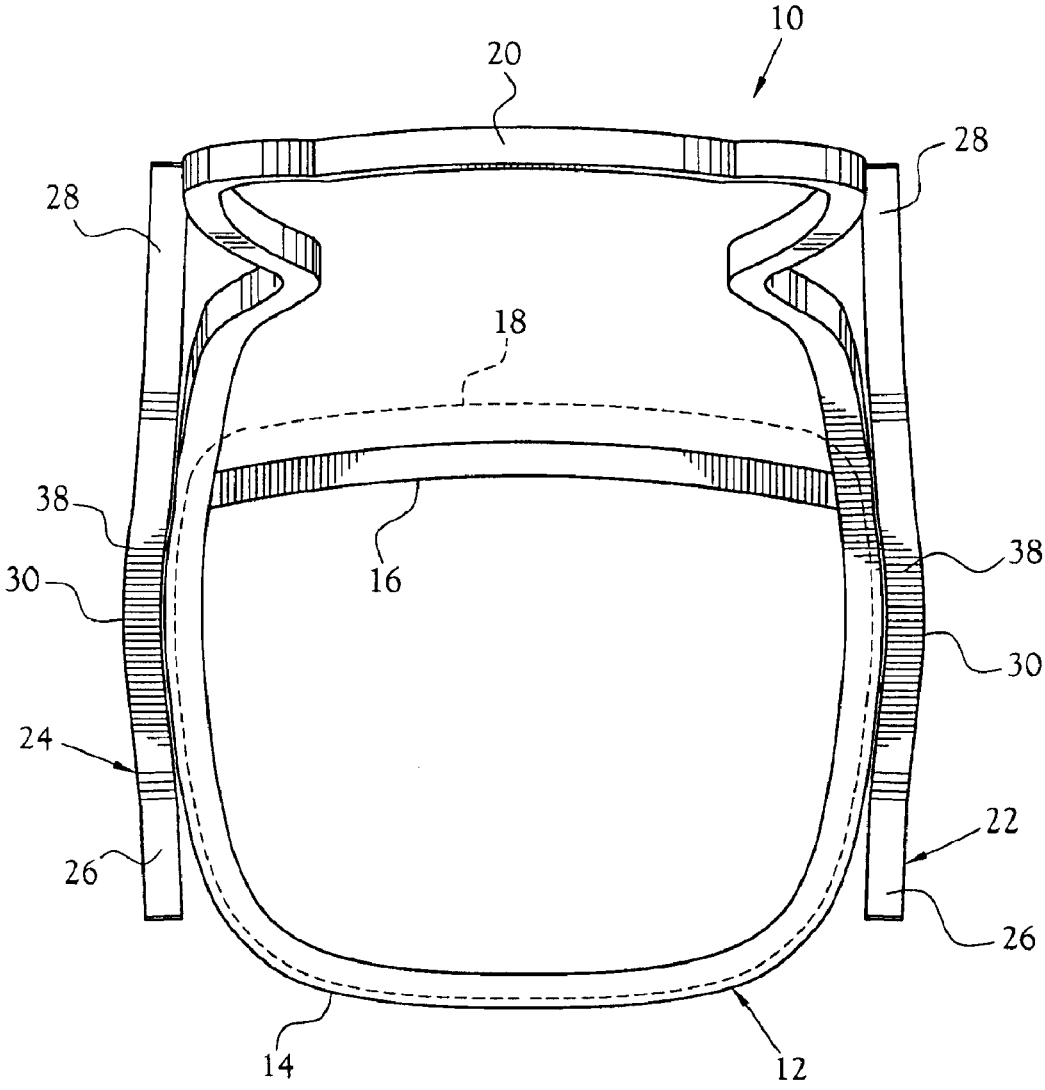
FIG. 5 is a top plan view of a chair frame for a stackable chair of the present invention.
Figure 6:
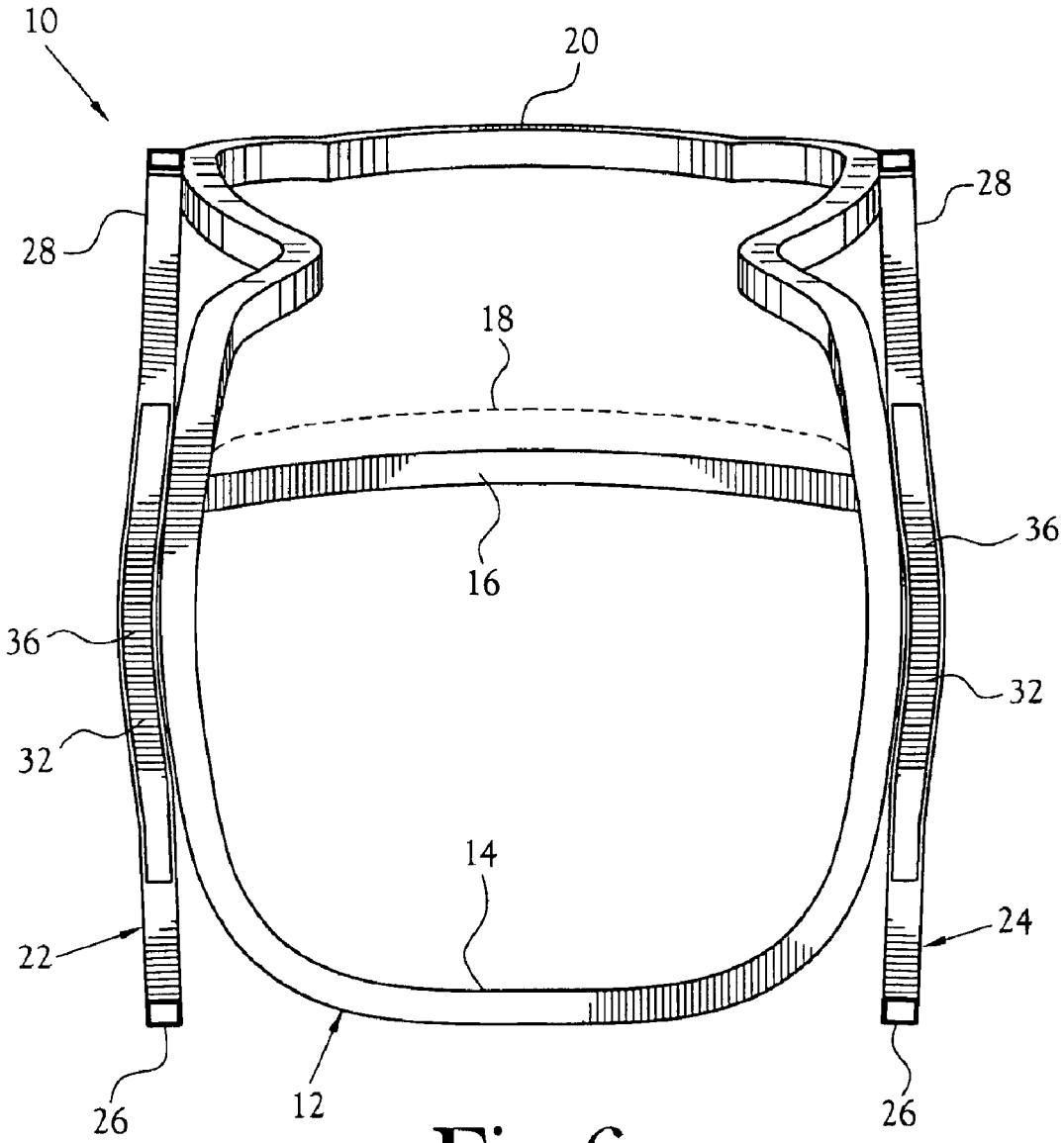
FIG. 6 is a bottom plan view of a chair frame for a stackable chair of the present invention.
Figure 7:
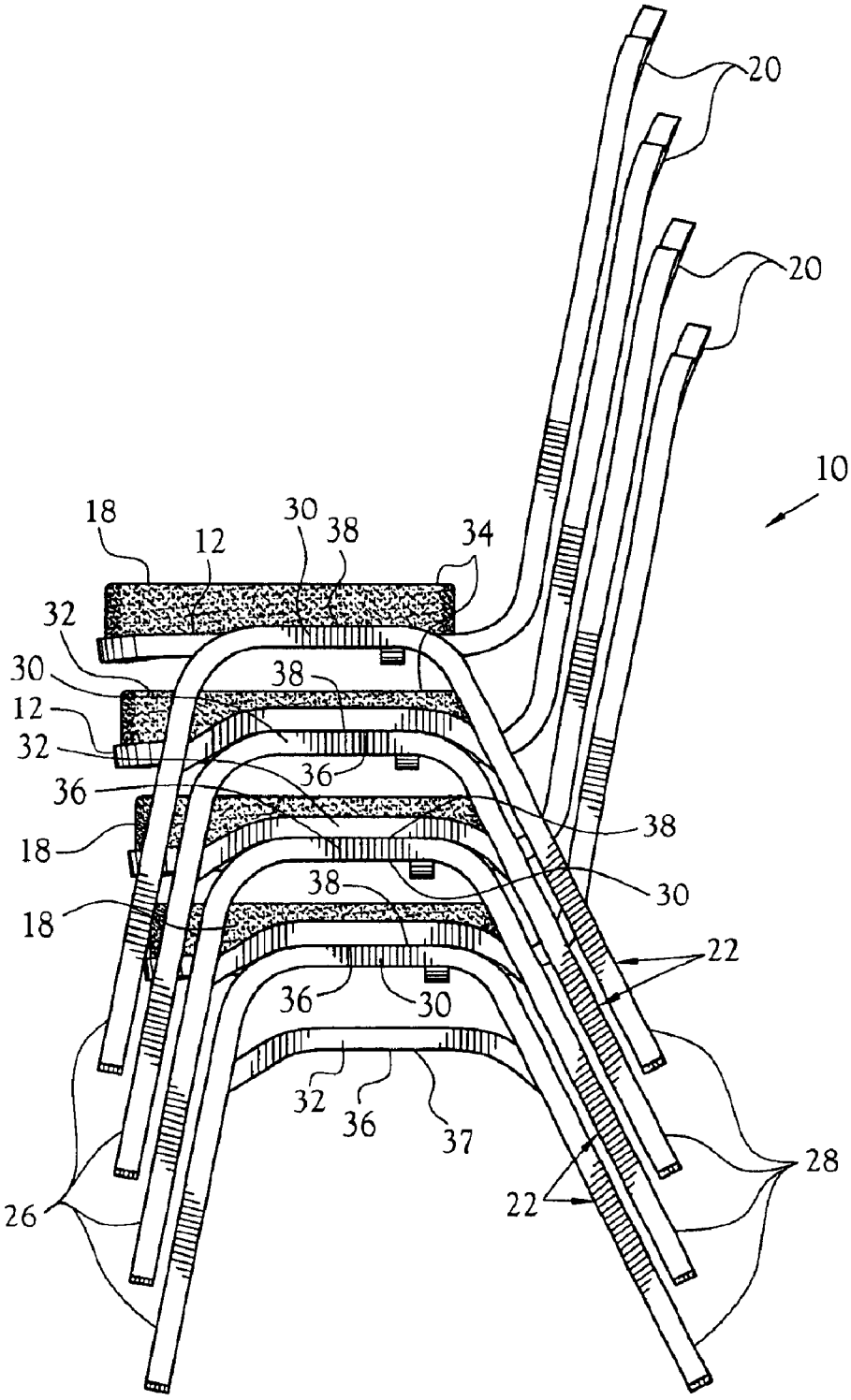
FIG. 7 is a side elevation view of a plurality of stackable chairs utilizing the chair frame of the present invention which are in a stacked configuration.

A chair frame for a stackable chair incorporating various features of the present invention is illustrated generally at 10 in FIGS. 1–7. As is illustrated in FIG. 7, and as will be discussed in detail below, the chairs 10 are designed such that they may be stacked, one upon another, to facilitate the storage of a plurality of chairs. For purposes of the discussion herein, the term "chair" is intended to include chairs, benches and stools, as well as other seating structures having legs of various lengths.

The chair frame 10 includes a seat support portion 12 which in the preferred illustrated embodiment defines a generally U-shaped frame portion 14 and a cross support member 16 which extends across, and is secured at its opposite ends to, the frame portion 14. The seat support portion 12 is used to support the seat portion of a chair utilizing the frame 10, such as the seat portion 18 illustrated in broken lines in the figures. Whereas the seat support portion 12 of the chair frame 10 is illustrated as being fabricated of a tubular material which supports the seat portion 18 proximate its perimeter, it is contemplated that the seat support portion 12 can define other configurations such as, for example, a platform (not shown) over which a seat cushion is positioned.

In the preferred embodiment the chair frame 10 also includes a seat back support portion 20 for supporting the seat back (not shown) of a chair utilizing the chair frame 10 of the present invention. It will, however, be recognized that not all chairs utilizing the chair frame 10 of the present invention will include a seat back and, thus, for some applications the chair frame 10 will not incorporate a seat back support portion 20.

The chair frame 10 also includes a pair of leg assemblies 22 and 24 disposed on opposite sides of, and attached to, the seat support portion 12. Each of the leg assemblies 22 and 24 includes a front leg 26 and a rear leg 28. The leg assemblies 22 and 24 also include an upper support member 30 which is disposed between the upper ends of the front leg 26 and the rear leg 28. As will be discussed in detail below, the upper support members 30 serve to support another chair utilizing a chair frame 10 which is stacked above. In the preferred embodiment, the support members 30 extend between, and serve to support the associated leg members 26 and 28.

Each of the leg assemblies 22 and 24 are also provided with a stacking bar 32 which extends between the front leg 26 and the rear leg 28, and which is selectively spaced below the upper support member 30. As illustrated in FIG. 7, the stacking bars 32 are designed to engage the upper support members 30 of the chair below when chairs utilizing the chair frame 10 are stacked. Accordingly, the upper chair is supported by its stacking bars 32 on the upper support members 30 of the chair below. It will be recognized that by supporting the chair above on the stacking bars 32, the seat support portion 12 of the chair frame 10 of the upper chair is maintained in a spaced position relative to the upper surface 34 of the seat portion 18 of the chair below such that damage to the seat portion 18 of the chair below is avoided.

Figure 8:
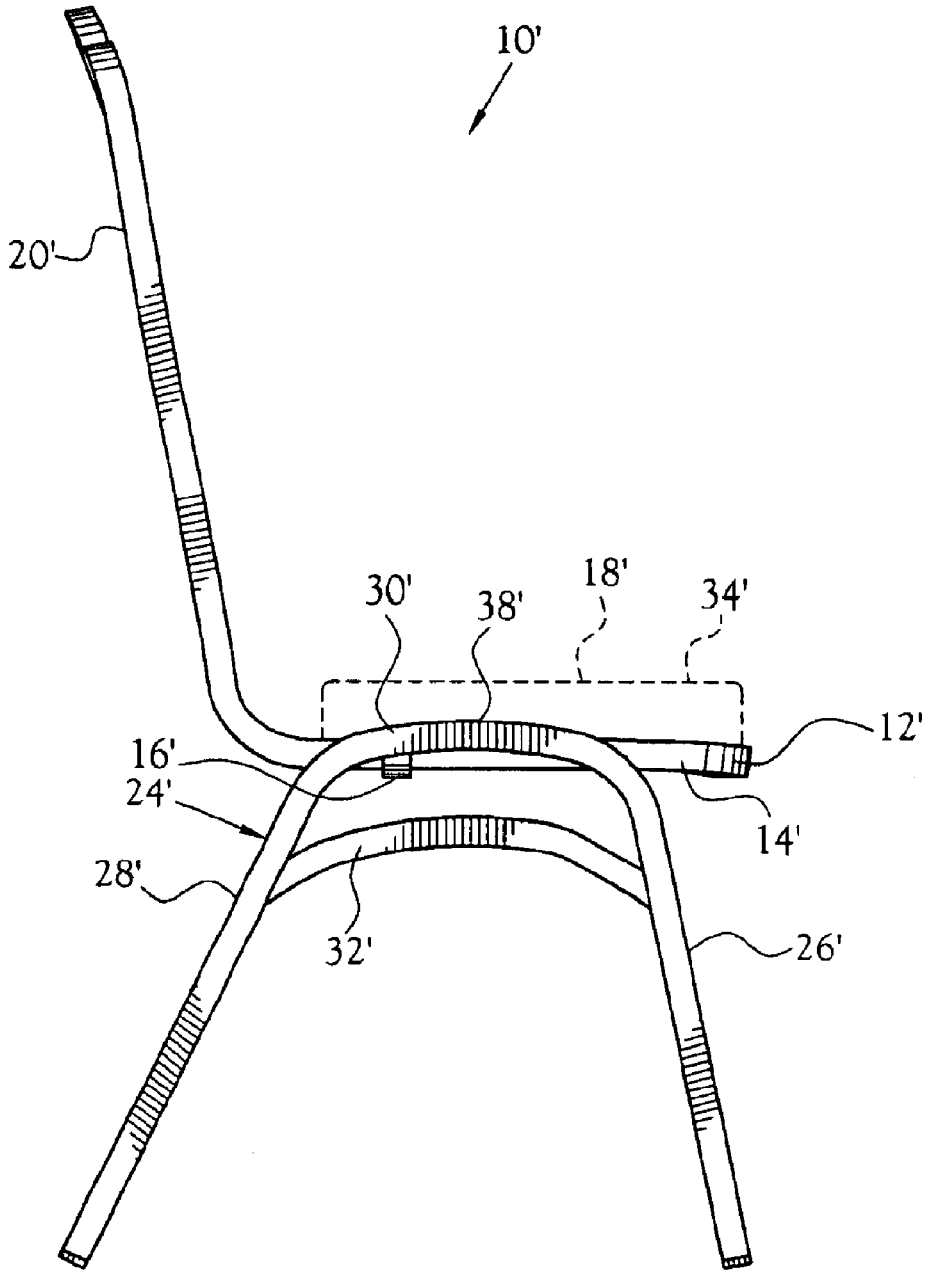
FIG. 8 is a side elevation view of an alternate embodiment of a chair frame for a stackable chair of the present invention.

Further, each of the stacking bars 32 has a lower surface 36, at least a portion of the length of which defines a curvilinear surface. It will be noted that in the illustrated preferred embodiment of FIGS. 1, 4, and 7 the curvilinear surface portion of the lower surface 36 is illustrated as a truncated concave surface having an intervening straight segment 37. It is, however, contemplated that the lower surface 36 of the stacking bars 32 can define various other curvilinear surface configurations, such as, for example, the continuous concave surface referenced at 36' in the alternate embodiment of the chair frame 10' illustrated in FIG. 8. Moreover, as will become clear from the discussion below, the curvilinear surface portion of the lower surface 36 need not extend the entire length of the stacking bars 32.

As illustrated in FIG. 7, and in order to facilitate the stable stacking of chairs utilizing the frame 10, at least a portion of the length of the upper surface 38 defines a curvilinear surface portion which is configured to closely engage at least a portion of the curvilinear surface portion of the lower surface 36 of a stacking bar 32 of the chair stacked above. Accordingly, in the preferred illustrated embodiment of FIG. 7, the upper surface 38 of the upper support member 30 has a curvilinear portion which defines a truncated convex surface which closely receives and supportably engages the truncated concaved surface portion of the lower surface 36 of a stacking bar 32. It will be understood that when chairs utilizing the frame 10 are stacked and the stacking bars 32 of an upper chair engage the upper supports members 30 of the chair below, the mating of the curvilinear surface portions of the lower surfaces 36 of the stacking bars 32 with the curvilinear surface portion of the upper surfaces 38 of the upper support members 30 fixes the relative position of the stacked chairs. In this regard, this mating of the curvilinear surface portions inhibits the stacking bars 32 from sliding along the length of the upper support members 30. Thus, unlike in the case of prior art chairs having straight stacking bars, chairs incorporating the chair frame 10 can be stacked without the risked that chairs within the stack will shift their relative positions, and destabilize the stack of chairs. Moreover, it will be recognized that, because the mating configuration of the upper support members 30 and the stacking bars 32 serves to orient and fix the relative position of the stacked chairs, the legs 26 and 28 of the frame 10 of a stacked chair need not engage the legs of the chair below to insure stability of the stack of chairs. Accordingly, damage to the chair legs during the stacking and unstacking process can be avoided.

It will also be understood that it is desirable to have the centers of gravity of the chairs within a stack of chair as close to vertically aligned as the particular chair configuration will allow. Such vertical alignment of the centers of gravity will increase the number of chairs which can be stacked without the stack becoming unstable. Because the mating curvilinear surface portions of the upper support members 30 and the stacking bars 32 determine the relative position of two stacked chairs utilizing the frame 10, the curvilinear surfaces can be preselected to effect the most stable orientation of the centers of gravity of the stacked chairs given the particular chair configuration involved. Of course, in prior art chairs having straight stacking bars the angle of the stacking bars can be preselected in an attempt to determine the relative centers of gravity of stacked chairs, but altering the angle of the stacking bars can exacerbate the problem of the stacking bars sliding on the upper support member of the chair below. Because the mating curvilinear surface portions of the chair frames 10 prohibit such sliding, the chair frames 10 allow better orientation of the centers of gravity of the stacked chairs, allowing a greater number of chairs to be stacked without the stack becoming unstable.

It will also be noted that the stacking bars 32 serve not only as supports on which a chair utilizing the frame 10 is supported when stacked upon another chair, but also serve as bracing structures which reinforce the legs 26 and 28. In this regard, each stacking bar 32 extends between the legs 26 and 28, and engages the operatively associated front leg 26 at a first point of engagement 40 and engages the operatively associated rear leg 28 at a second point of engagement 42. It will be recognized by those skilled in the art that for purposes of bracing or strengthening the legs 26 and 28 it is desirable to have the points of engagement 40 and 42 positioned as low as possible on the length of legs 26 and 28 such that less of the length of the legs 26 and 28 extend below the points of engagement 40 and 42. Where the concave or truncated concave surface configuration is used for the lower surfaces 36 of the stacking bars 32, the stacking bars 32 allow chairs using the frame 10 to be stacked close together while still allowing the stacking bars 32 to engage the legs 26 and 28 at a point significantly spaced from the upper ends of the legs 26 and 28, thereby leaving less of the lower portion of the legs 26 and 28 unsupported. This allows the stacking bars 32 to effectively brace the legs 26 and 28 resulting in a stronger chair frame. In this regard, in prior art chairs utilizing straight stacking bars, to obtain close spacing of the stacked chairs the stacking bars must be in close proximity to the upper support members such that the stacking bars engage the legs proximate their upper ends. However, placing the points of engagement of the stacking bars proximate the upper support members leaves more of the length of the leg unsupported, and this significantly reduces the effectiveness of the stacking bars as leg bracing structures. The advantageous curved configuration of the stacking bars 32 of the present invention insures that structural support is not sacrificed in order to achieve the close stacking of chairs utilizing the frame 10.

As illustrated in FIGS. 5 and 6, in the preferred embodiment of the chair frame 10 both the upper support members 30 and the stacking bars 32 curve outwardly to allow the seat portion 18 to define a more rounded perimeter. Particularly where chairs are used in conjunction with a table, this rounded perimeter can make it easier for users of a chair to seat themselves, or to remove themselves from the chair. Because the mating curvilinear surface portions of the upper support members 30 and the stacking bars 32 prohibit sliding of the stacking bars 32 with respect to the upper support members 30, the stacking bars 32 and upper support members 30 can be outwardly curved to allow this advantageous rounded seat portion configuration. In this regard, it will be recognized that in prior art chairs utilizing stacking bars with straight lower surfaces, outwardly curving the stacking bars is typically avoided since the forward or rearward sliding of the stacking bars with respect to the upper support members can reduce the area of engagement between such structures so as to make a stack of chairs less stable.

In light of the above, it will be recognized present invention provides a chair frame 10 with great advantages over the prior art. The mating curvilinear surface portions of the upper support members 30 and the stacking bars 32 prohibit sliding of the stacking bars 32 with respect to the upper support members 30, thereby allowing a greater number of chairs to be stacked without the stack becoming unacceptably unstable. Moreover, the frames 10 accommodate the use of rounded seat portions, and a more efficient chair design. While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicants' general inventive concept.

Having thus described the aforementioned invention, we claim:

1. A chair frame for a stackable chair, said chair frame comprising:

a seat support portion;

first and second front legs secured to said seat support portion;

first and second rear legs secured to said seat support portion;

first and second upper support members secured to said seat support portion, each said first and second upper support member having an upper surface, at least a portion of said upper surface defining a curvilinear surface portion; and first and second stacking bars, said first stacking bar being disposed between said first front leg and said first rear leg, and being selectively spaced below said first upper support member, said second stacking bar being disposed between said second front leg and said second rear leg, and being selectively spaced below said second upper support member, each said first and second stacking bar having a lower surface, at least a portion of said lower surface defining a curvilinear surface portion configured to closely engage at least a portion of said curvilinear surface portion of said upper surface of one said upper support member of another said chair frame to facilitate the stacking of said chair frame in a spaced position relative to a seat support portion on another said chair frame, said curvilinear surface portions of said first and second upper support members being configured and disposed relative to said first and second front legs and said first and second rear legs such that when said curvilinear surface portions of said first and second upper support members of said chair frame closely engage said curvilinear surface portions of said lower surfaces of said first and second stacking bars of a second said chair frame stacked thereon, said second chair frame is releasably restrained from sliding along the length of said first and second stacking bars of said chair frame upon which it is stacked and said first and second front legs and said first and second rear legs of said second chair are releasably maintained in a spaced relationship with respect to said first and second front legs and said first and second rear legs, respectively, of said chair frame upon which said second chair frame is stacked;

whereby during stacking of said chair frame, said seat support portion of said chair frame is maintained in said spaced position relative to the seat support portion on another said chair frame thereby avoiding contact with each seat support portion on respective stacked chair frames, and whereby said second chair frame is releasably restrained from sliding along the length of said first and second stacking bars of said chair frame upon which it is stacked and said first and second front legs and said first and second rear legs of said second chair are releasably maintained in a spaced relationship with respect to said first and second front legs and said first and second rear legs, respectively, of said chair frame upon which said second chair frame is stacked.

2. The chair frame of claim 1 wherein said curvilinear surface portion of each said upper support member defines a convex surface portion, and wherein said curvilinear surface portion of each said stacking bar defines a concave surface portion for closely engaging at least a portion of said convex surface portion of one said upper support member of another said chair frame.

3. The chair frame of claim 1 wherein said curvilinear surface portion of each said upper support member defines a truncated convex surface portion, and wherein said curvilinear surface portion of each said stacking bar defines a truncated concave surface portion for closely engaging at least a portion of said convex surface portion of one said upper support member of another said chair frame.

4. The chair frame of claim 1 wherein said first upper support member engages and extends between said first front leg and said first rear leg, and said second upper support member engages and extends between said second front leg and said second rear leg.

5. The chair frame of claim 4 wherein said first front leg and said first rear leg are secured to said seat support portion by securing said first upper support member to said seat support portion, and wherein said second front leg and said second rear leg are secured to said seat support portion by securing said second upper support member to said seat support portion.

6. The chair frame of claim 1 wherein said first stacking bar engages and extends between said first front leg and said first rear leg, and wherein said second stacking bar engages and extends between said second front leg and said second rear leg.

7. The chair frame of claim 1 wherein said first and second upper support members curve outwardly, and said first and second stacking bars curve outwardly, to facilitate the use of said chair frame with a chair having a seat portion defining a rounded perimeter.

8. The chair frame of claim 1 wherein said chair frame includes a seat back support portion.

9. A chair frame for a stackable chair, said chair frame comprising:

a seat support portion;

first and second front legs;

first and second rear legs;

first and second upper support members secured to said seat support portion, said first upper support member engaging and extending between said first front leg and said first rear leg, and said second upper support member engaging and extending between said second front leg and said second rear leg, each said first and second upper support member having an upper surface, at least a portion of said upper surface defining a curvilinear surface portion; and first and second stacking bars, said first stacking bar engaging and extending between said first front leg and said first rear leg, and being selectively spaced below said first upper support member, said second stacking bar engaging and extending between said second front leg and said second rear leg, and being selectively spaced below said second upper support member, each said first and second stacking bar having a lower surface, at least a portion of said lower surface defining a curvilinear surface portion configured to closely engage at least a portion of said curvilinear surface portion of said upper surface of one said upper support member of another said chair frame to facilitate the stacking of said chair frame in a spaced position relative to a seat support portion on another said chair frame, said curvilinear surface portions of said first and second upper support members being configured and disposed relative to said first and second front legs and said first and second rear legs such that when said curvilinear surface portions of said first and second upper support members of said chair frame closely engage said curvilinear surface portions of said lower surfaces of said first and second stacking bars of a second said chair frame stacked thereon, said second chair frame is releasably restrained from sliding along the length of said first and second stacking bars of said chair frame upon which it is stacked and said first and second front legs and said first and second rear legs of said second chair are releasably maintained in a spaced relationship with respect to said first and second front legs and said first and second rear legs, respectively, of said chair frame upon which said second chair frame is stacked;

whereby each chair frame is maintained in spaced positioning on another said chair frame with said seat support portion of said chair frame maintained in said spaced position relative to the seat support portion on another said chair frame and respective front and rear legs of said chair frame maintained in spaced positioning from respective front and rear legs of another said chair frame, and whereby said second chair frame is releasably restrained from sliding along the length of said first and second stacking bars of said chair frame upon which it is stacked and said first and second front legs and said first and second rear legs of said second chair are releasably maintained in a spaced relationship with respect to said first and second front legs and said first and second rear legs, respectively, of said chair frame upon which said second chair frame is stacked.

10. The chair frame of claim 9 wherein said curvilinear surface portion of each said upper support member defines a convex surface portion, and wherein said curvilinear surface portion of each said stacking bar defines a concave surface portion for closely engaging at least a portion of said convex surface portion of one said upper support member of another said chair frame.

11. The chair frame of claim 9 wherein said curvilinear surface portion of each said upper support member defines a truncated convex surface portion, and wherein said curvilinear surface portion of each said stacking bar defines a truncated concave surface portion for closely engaging at least a portion of said convex surface portion of one said upper support member of another said chair frame.

12. The chair frame of claim 11 wherein said first and second upper support members curves outwardly to facilitate the use of said chair frame in a chair having a seat portion defining a rounded perimeter, and said first and second stacking bars curve outwardly to facilitate engagement with said upper support members of another said chair frame.

13. The chair frame of claim 12 wherein said chair frame includes a seat back support portion.

14. A chair frame for a stackable chair, said chair frame comprising:

a seat support portion;

first and second front legs;

first and second rear legs;

first and second upper support members secured to said seat support portion, said first upper support member engaging and extending between said first front leg and said first rear leg, and said second upper support member engaging and extending between said second front leg and said second rear leg, each said first and second upper support member having an upper surface, at least a portion of said upper surface defining a curvilinear surface portion, each said first and second upper support member being outwardly curved to facilitate the use of said chair frame with a chair having a seat portion defining a rounded perimeter; and first and second stacking bars, said first stacking bar engaging and extending between said first front leg and said first rear leg, and being selectively spaced below said first upper support member, said second stacking bar engaging and extending between said second front leg and said second rear leg, and being selectively spaced below said second upper support member, each said first and second stacking bar having a lower surface for closely engaging at least a portion of said upper surface of one said upper support member of another said chair frame to facilitate the stacking of said chair frame on another said chair frame, at least a portion of said lower surface defining a curvilinear surface portion configured to closely engage at least a portion of said curvilinear surface portion of said upper surface of one said upper support member of another said chair frame to facilitate the stacking of said chair frame in a spaced position relative to a seat support portion on another said chair frame, said curvilinear surface portions of said first and second upper support members being configured and disposed relative to said first and second front legs and said first and second rear legs such that when said curvilinear surface portion of said first and second upper support members of said chair frame closely engage said curvilinear surface portions of said lower surfaces of said first and second stacking bars of a second said chair frame stacked thereon, said second chair frame is releasably restrained from sliding along the length of said first and second stacking bars of said chair frame upon which it is stacked and said first and second front legs and said first and second rear legs of said second chair are releasably maintained in a spaced relationship with respect to said first and second front legs and said first and second rear legs, respectively, of said chair frame upon which said second chair frame is stacked, each said stacking bar being outwardly curved to facilitate the engagement of said first and second stacking bars with said first and second upper support members of another said chair frame;

whereby each chair frame is maintained in spaced positioning on another said chair frame with said seat support portion of said chair frame maintained in said spaced position relative to the seat support portion on another said chair frame and respective front and rear legs of said chair frame maintained in spaced positioning from respective front and rear legs of another said chair frame, and whereby said second chair frame is releasably restrained from sliding along the length of said first and second stacking bars of said chair frame upon which it is stacked and said first and second front legs and said first and second rear legs of said second chair are releasably maintained in a spaced relationship with respect to said first and second front legs and said first and second rear legs, respectively, of said chair frame upon which said second chair frame is stacked.

* * * * *